United States Patent [19]

Inagaki et al.

[11] Patent Number: 4,824,764

[45] Date of Patent: Apr. 25, 1989

[54] SILVER HALIDE PHOTOGRAPHIC MATERIAL

[75] Inventors: Yoshio Inagaki; Nobuaki Inoue, both of Kanagawa, Japan

[73] Assignee: Fuji Photo Film Co., Ltd., Kanagawa, Japan

[21] Appl. No.: 51,800

[22] Filed: May 20, 1987

[30] Foreign Application Priority Data

May 20, 1986 [JP] Japan ..... 61-115036

[51] Int. Cl.[4] ..... G03C 1/10; G03C 1/34

[52] U.S. Cl. ..... 430/264; 430/949; 430/607; 430/599; 430/600; 430/613

[58] Field of Search ..... 430/264, 949, 607, 599, 430/600, 613

[56] References Cited

U.S. PATENT DOCUMENTS

| | | | |
|---|---|---|---|
| 4,224,401 | 9/1980 | Takada et al. | 430/348 |
| 4,269,929 | 5/1981 | Nothnagle | 430/264 |
| 4,323,643 | 4/1982 | Mifune et al. | 430/949 |
| 4,681,836 | 7/1987 | Inoue et al. | 430/949 |

*Primary Examiner*—Won H. Louie

*Attorney, Agent, or Firm*—Sughrue, Mion, Zinn, Macpeak and Seas

[57] ABSTRACT

A silver halide photographic material comprising a support having at least one light-sensitive silver halide emulsion layer on the support, wherein at least one of the emulsion layer and other constituent layers contains at least one compound represented by formula (I) and at least one compound represented by formula (II):

(I)

wherein $R_0$ is an organic group having 7 to 30 carbon atoms, A is a substituted or unsubstituted phenylene group, or a substituted or unsubstituted naphthylene group, and X is NH or 0, (II)

wherein $R_1$ is an aliphatic, aromatic or heterocyclic group; $R_2$ is a hydrogen atom, a substituted or unsubstituted alkyl group, a substituted or unsubstituted aralkyl group, a substituted or unsubstituted alkoxy group, a substituted or unsubstituted aryl group, a substituted or unsubstituted aryloxy group, or a substituted or unsubstituted amino group; G is a carbonyl group, a sulfonyl group, a sulfoxy group, a phosphoryl group, or an N-substituted or unsubstituted iminomethylene group (NH=C<); $R_{10}$ and $R_{100}$ are both hydrogen atoms, or one or $R_{10}$ and $R_{100}$ is a hydrogen atom and the other is a substituted or unsubstituted alkylsulfonyl group, a substituted or unsubstituted arylsulfonyl group, or an acyl group; and G, $R_2$, $R_{100}$ and the nitrogen atom to which G, $R_2$ and $R_{100}$ are linked may form a partial structure of hydrazone (—N=C<), provided that the compound represented by formula (II) is not the same with the compound represented by formula (I), and the total number of carbon atoms of $R_1$ and $R_2$ is 14 to 60.

6 Claims, No Drawings

SILVER HALIDE PHOTOGRAPHIC MATERIAL

FIELD OF THE INVENTION

The present invention relates to a silver halide photographic material and more particularly to a silver halide photographic material capable of forming a super high contrast negative image useful for photochemical process, using a stable processing solution.

BACKGROUND OF THE INVENTION

In a photomechanical process, to improve the reproduction of continuous gradation with a dot image or the reproduction of line images, it is necessary to obtain photographic characteristics of super high contrast (particularly having a gamma value of not less than 10). For this purpose, a method using a combination of a light-sensitive material comprising a silver chloride emulsion or a silver chlorobromide emulsion having a high silver chloride content and a hydroquinone developer (infectious developer) wherein the effective concentration of sulfite ions is markedly decreased, usually to not more than 0.1 mol/l, has usually been employed. This method using such infectious developers (lith developers), however, has a problem in that the developer is seriously unstable and cannot be stored for more than 3 days because the sulfite ion concentration of the developer is low.

As an improved method for obtaining photographic characteristics of super high contrast using a stable developer, a method using specific hydrazine derivatives as described in U.S. Pat. No. 4,224,401 is known. In accordance with this method, a high concentration of sulfite ions is allowed to exist in the developer and thus the developer is protected against air oxidation, leading to an increase in the stability thereof.

U.S. Pat. No. 4,269,929 discloses an improved method over the above super high contrast image-forming method using hydrazine derivatives, in which in order to obtain a negative image having a high gamma value, a developer having a lower pH value is used, and amine compounds are added to the developer.

In this method, when compounds having a low molecular weight among acylhydrazine derivatives are dissolved in the developer, the compounds exert adverse influences on other light-sensitive materials, particularly light-sensitive materials for rapid access, and thereby cause an increase in fog. It is therefore preferred to use acylhydrazine derivatives having a ballast group to provide diffusion resistance to make them difficult to be dissolved in the processing solution. With such diffusion resistance type of hydrazines, however, photographic characteristics of high sensitivity and high contrast are often difficult to obtain. In order to obtain such characteristics, it is necessary for the hydrazines to be added in a large amount. In addition, a problem arises in that with a solution in which the activity has been decreased as a result of processing a large number of light-sensitive materials, the sensitivity and gradation $\gamma$ are decreased.

It has been found that to overcome the above problems, it is effective to use compounds having a diffusion resistant group among acylhydrazine derivatives having a urea connecting group. However, a light-sensitive material using such hydrazine derivatives has problems in that the sensitivity and gradation are decreased when the material is stored for a long period of time, particularly under high temperature and humidity conditions.

Thus a system in which the above problems of a light-sensitive material using acylhydrazine derivatives, i.e., reductions in sensitivity and gamma value resulting from the processing using a low activity developer deteriorating the processing solution and the long term storage, have been overcome has been strongly desired.

SUMMARY OF THE INVENTION

It is an object of the present invention to provide a silver halide photographic material which provides photographic characteristics of super high contrast, is suitable for the use of a stable processing solution, does not deteriorate the processing solution, is free from a significant reduction in performance even when the activity of the processing solution has been reduced as a result of processing of a large number of light-sensitive materials, and further is excellent in storage stability.

The present invention relates to a silver halide photographic material comprising a support having at least one light-sensitive silver halide emulsion layer on the support, wherein at least one layer of the silver halide emulsion layer and other constituent layers contains at least one compound represented by formula (I) and at least one compound represented by formula (II):

$$R_0-X-\overset{\overset{\displaystyle O}{\|}}{C}NH-A-NHNH\overset{\overset{\displaystyle O}{\|}}{C}-H \qquad (I)$$

wherein $R_0$ is an organic group having 7 to 30 carbon atoms, A is a substituted or unsubstituted phenylene group, or a substituted or unsubstituted naphthylene group, and X is NH or O, $$R_1-\underset{\underset{\displaystyle R_{10}}{|}}{N}-\underset{\underset{\displaystyle R_{100}}{|}}{N}-G-R_2 \qquad (II)$$

wherein $R_1$ is an aliphatic, aromatic or heterocyclic group; $R_2$ is a hydrogen atom, a substituted or unsubstituted alkyl group, a substituted or unsubstituted aralkyl group, a substituted or unsubstituted alkoxy group, a substituted or unsubstituted aryl group, a substituted or unsubstituted aryloxy group, or a substituted or unsubstituted amino group; G is a carbonyl group, a sulfonyl group, a sulfoxy group, a phosphoryl group, or an N-substituted or unsubstituted iminomethylene group (NH=C<); $R_{10}$ and $R_{100}$ are both hydrogen atoms, or one of $R_{10}$ and $R_{100}$ is a hydrogen atom and the other is a substituted or unsubstituted alkylsulfonyl group, a substituted or unsubstituted arylsulfonyl group, or an acyl group; and G, $R_2$, $R_{100}$ and the nitrogen atom to which G, $R_2$ and $R_{100}$ are linked may form a partial structure of hydrazone (—N=C<), provided that the compound represented by formula (II) is not the same with the compound represented by formula (I), and the total number of carbon atoms of $R_1$ and $R_2$ is 14 to 60.

DETAILED DESCRIPTION OF THE INVENTION

The formula (I) will hereinafter be explained in detail.

The organic groups represented by $R_0$ in formula (I) include a substituted or unsubstituted alkyl group (preferably, an 2-ethylhexyl group, an 2-dodecyloxyethyl group, or a 3-(2,4-di-t-pentylphenoxy)propyl group), a substituted or unsubstituted phenyl group (preferably, a 4-butylphenyl group, a 2,4-di-t-pentylphenyl group, or a 3-pentadecylphenyl group), a substituted or unsubstituted naphthyl group (preferably, a naphthyl group, or a 7-hydroxynaphthyl group), and a substituted or unsubstituted heterocyclic group (preferably, a 5-(2-ethylhexylcarbamoyl)pyridine-2-yl, or 4-dodecylpiperazine-1-yl) (a 5- or 6-membered hetero ring containing at least one oxygen, nitrogen or sulfur atom, which may combine together with a benzene ring or other hetero ring to form a condensed ring), and preferably has 10 to 30 carbon atoms.

Substitutents (a) for the substituted A or $R_0$ group are described below.

Typical examples of the substituents (i) include a straight chain, branched chain or cyclic alkyl group (preferably having 1 to 20 carbon atoms), an aralkyl group (preferably monocyclic or dicyclic; the number of carbon atoms of the alkyl portion being 1 to 3), an alkoxy group (preferably having 1 to 20 carbon atoms), an amino group substituted with one or two substituents (preferably substituted with an alkyl group, an acyl group, or an alkyl or arylsulfonyl group, having 1 to 20 carbon atoms; when two substituents are present, the total number of carbon atoms in the substituents is not more than 20), an unsubstituted ureido group or a ureido group substituted with one to three substituents (preferably having 1 to 29 carbon atoms), a substituted or unsubstituted aryl group (preferably mono- or dicyclic, having 6 to 29 carbon atoms), a substituted or unsubstituted arylthio group (preferably having 6 to 29 carbon atoms), a substituted or unsubstituted alkylthio group (preferably having 1 to 29 carbon atoms), a substituted or unsubstituted alkylsulfoxy group (preferably having 1 to 29 carbon atoms), a substituted or unsubstituted arylsulfoxy group (preferably having 6 to 29 carbon atoms and being mono- or dicyclic), a substituted or unsubstituted alkylsulfonyl group (preferably having 1 to 29 carbon atoms), a substituted or unsubstituted arylsulfonyl group (preferably having 6 to 29 carbon atoms in the total molecule and being mono- or dicyclic), an aryloxy group (preferably having 6 to 29 carbon atoms and being mono- or dicyclic), a carbamoyl group (preferably having 1 to 29 carbon atoms), a sulfamoyl group (preferably having 1 to 29 carbon atoms), a hydroxy group, a halogen atom (e.g., F, Cl, Br and I), a sulfonic acid group and a carboxylic acid group.

Groups among the above substituents (a) (i.e., the substituents for the substituted a or $R_0$ group) which may be further substituted may have the following substituents (b).

Typical examples of the substituents (b) include a alkyl group (having 1 to 20 carbon atoms), an aryl group (preferably having 6 to 20 carbon atoms and being mono- or dicyclic), an ureido group (preferably having 1 to 20 carbon atoms), an alkoxy group (preferably having 1 to 20 carbon atoms), an aryloxy group (preferably having 6 to 20 carbon atoms), an alkylthio group (preferably having 1 to 20 carbon atoms), an arylthio group (preferably having 6 to 20 carbon atoms), an alkylsulfonyl group (preferably having 1 to 20 carbon atoms), an arylsulfonyl group (preferably having 6 to 20 carbon atoms), a carbonamido group (preferably having 1 to 20 carbon atoms), a sulfonamide group (preferably having 0 to 20 carbon atoms), a carbamoyl group (preferably having 1 to 20 carbon atoms), a sulfamoyl group (preferably having 1 to 20 carbon atoms), an alkylsulfoxy group (preferably having 1 to 20 carbon atoms), an arylsulfoxy group (preferably having 1 to 20 carbon atoms), an ester group (preferably having 2 to 20 carbon atoms), a hydroxy group, —COOM and —$SO_2M$ (wherein M is a hydrogen atom, an alkali metal atom, or a substituted or unsubstituted ammonium group), and a halogen atom (e.g., F, Cl, Br and I). These groups may be bonded together to form a ring.

Preferred substituents among the above substituents (i.e., the substituent (b)) are an alkyl group having 1 to 20 carbon atoms, with a branched alkyl group having 3 to 20 carbon atoms being particularly preferred; an ureido group having 1 to 20 carbon atoms, with an ureido group having the formula, —$NHCONH_2$ or —NHCONH— being particularly preferred; an alkoxy group having 1 to 20 carbon atoms, with a branched alkoxy group having 3 to 20 carbon atoms being particularly preferred; a substituted or unsubstituted phenoxy group (having 6 to 20 carbon atoms), with a phenoxy group (having 9 to 20 carbon atoms) substituted with a branched alkyl group being particularly preferred; a carbamoyl group (having 1 to 20 carbon atoms); a carbonamido group (having 1 to 20 carbon atoms); a sulfonamide group (having 1 to 20 carbon atoms); a sulfamoyl group (having 1 to 20 carbon atoms); a carboxy group (—COOH); a group —$SO_3M$ (wherein M is an alkali metal or a hydrogen atom); F and Cl.

These compounds can be synthesized referring to the disclosure of Japanese Patent Application (OPI) No. 67843/81 (the term "OPI" as used herein means a "published unexamined Japanese patent application"), for example, and is described in more detail below.

Representative examples of the compounds represented by formula (I) are shown below although the present invention is not intended to be limited thereto.

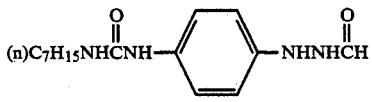

I-1

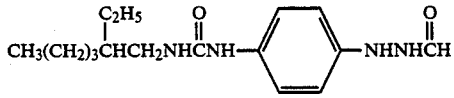

I-2

-continued
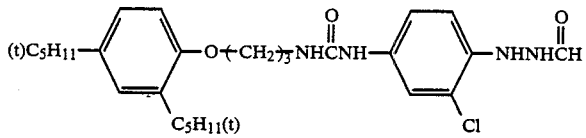
I-3
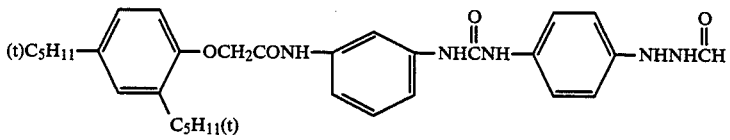
I-4
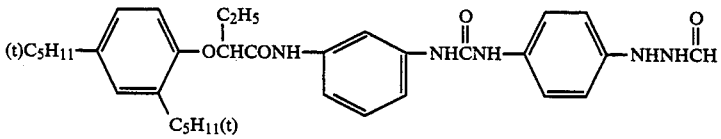
I-5
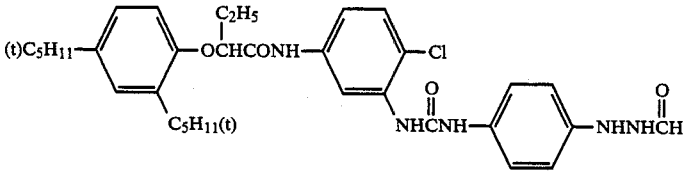
I-6
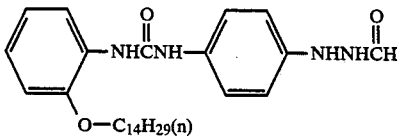
I-7
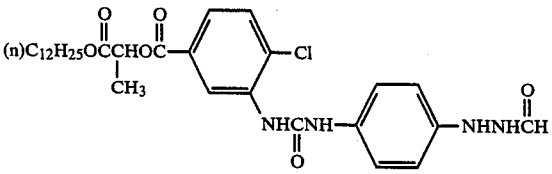
I-8
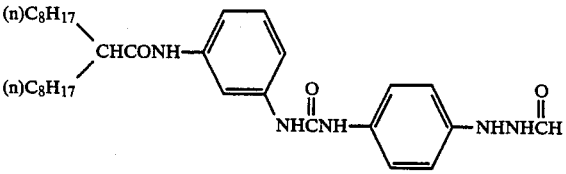
I-9
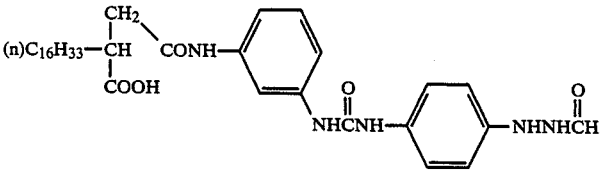
I-10
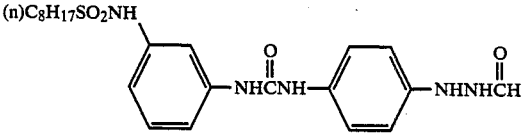
I-11

-continued
I-12
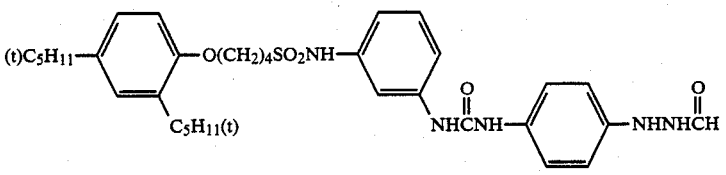
I-13
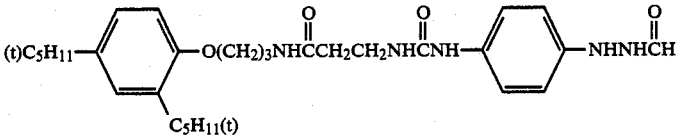
I-14
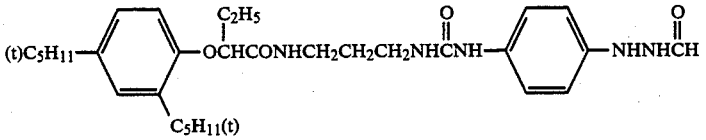
I-15
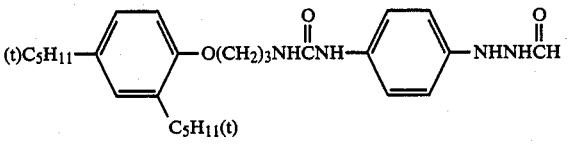
I-16
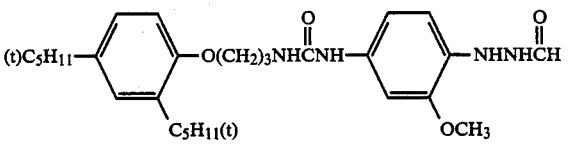
I-17
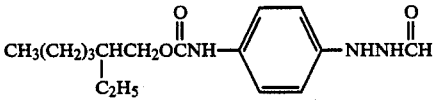
I-18
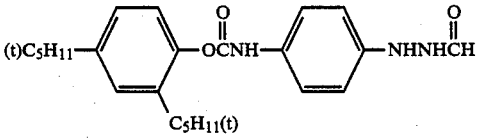
I-19
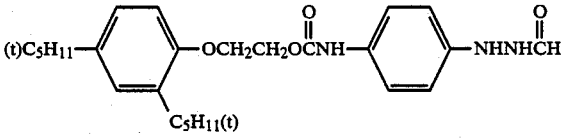
I-20
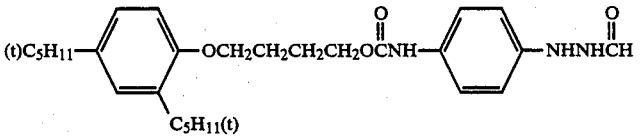
I-21
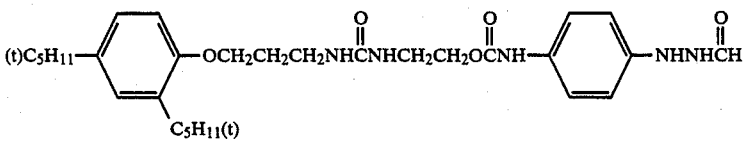
Formula (II) will hereinafter be explained in detail.
The aliphatic group represented by $R_1$ in formula (II) is a straight chain, branched chain or cyclic alkyl group, preferably having 1 to 30 carbon atoms, particularly preferably having 1 to 20 carbon atoms.

Preferred as the heterocyclic group represented by $R_1$ is a 3- to 10-membered saturated or unsaturated heterocyclic group containing at least one O, N or S atom. The saturated or unsaturated heterocyclic group may combine together with a mono- or dicyclic aryl group to form a condensed ring.

These alkyl and saturated or unsaturated heterocyclic groups may be substituted with the following groups: an aryl group having 6 to 20 carbon atoms, an alkoxy group having 1 to 20 carbon atoms, a sulfinyl group having 1 to 20 carbon atoms, a sulfonyl group having 1 to 20 carbon atoms, a a sulfonamide group having 0 to 20 carbon atoms, a carbonamido group having 1 to 20 carbon atoms and the above saturated or unsaturated heterocyclic groups.

The aromatic group represented by $R_1$ in a mono- or dicyclic aryl group.

Preferred examples of the aromatic group (and the saturated or unsaturated group include a phenyl group, a naphthyl group, a pyridyl group, a pyrimidyl group, an imidazolyl group, a pyrazolyl group, a quinolyl group, an isoquinolyl group, a benzimidazolyl group, a thiazolyl group and a benzthiazolyl group. Of these groups, groups containing a benzene ring are particularly preferred.

A particularly preferred example of $R_1$ is an aryl group. This aryl group may have the substituents such as a straight chain, branched chain or cyclic alkyl group (preferably having 1 to 20 carbon atoms), an aralkyl group (preferably a mono- or dicyclic group: the number of carbon atoms in the alkyl portion being 1 to 3), an alkoxy group (preferably having 1 to 20 carbon atoms), an aryloxy group (preferably having 6 to 20 carbon atoms), an amino group having one or two substituents (preferably an alkyl group having 1 to 20 carbon atoms; when two substituents are present, the total number of carbon atoms in the substituents is not more than 20), a sulfamoyl group (preferably having 0 to 20 carbon atoms), a carbamoyl group (preferably having 1 to 20 carbon atoms), a substituted or unsubstituted alkylcarbonamido group (preferably having 2 to 30 carbon atoms), a substituted or unsubstituted acylcarbonamide group (preferably having 7 to 30 carbon atoms), a substituted or unsubstituted alkyl or arylsulfonamide group (preferably having 1 to 30 carbon atoms and 6 to 30 carbon atoms, respectively), a substituted ureido group having one to three substituents or an unsubstituted ureido group (preferably having 1 to 30 carbon atoms), a substituted or unsubstituted aryl group (preferably mono- or dicyclic, having to 6 to 30 carbon atoms), a substituted or unsubstituted alkylthio group (preferably having 1 to 30 carbon atoms), a substituted or unsubstituted arylthio group (preferably mono- or dicyclic, having 6 to 30 carbon atoms), a substituted or unsubstituted alkylsulfinyl group (preferably having 1 to 30 carbon atoms), a substituted or unsubstituted arylsulfinyl group (preferably mono- or dicyclic, having 6 to 30 carbon atoms), a substituted or unsubstituted alkylsulfonyl group (preferably having 1 to 30 carbon atoms), a substituted or unsubstituted arylsulfonyl group (preferably mono- or dicyclic, having 6 to 30 carbon atoms), a hydroxyl group, and a halogen atom (e.g., F, Cl, Br and I).

Examples of substituents for the above alkyl- or arylcarbonamido group and sulfonamide group include an alkoxy group (preferably having 1 to 20 carbon atoms), an aryloxy group (preferably having 6 to 26 carbon atoms), an alkylthio group (preferably having 1 to 20 carbon atoms), an alkylsulfonyl group (preferably having 1 to 20 carbon atoms), a halogen atom (e.g., F, Cl, Br and I), and an ureido group having one or three substituents (preferably having 1 to 30 carbon atoms).

Preferred as substituents for the above ureido group are a substituted or unsubstituted, straight chain, branched chain or cyclic alkyl group (preferably having 1 to 30 carbon atoms), a substituted or unsubstituted phenyl group or naphthyl group.

The above substituents (i.e., the substituents for $R_1$) may be further substituted with the groups such as an alkoxy group having 1 to 20 carbon atoms, an aryloxy group having 6 to 20 carbon atoms, an alkylthio group having 1 to 20 carbon atoms, an alkylsulfonyl group having 1 to 20 carbon atoms, an alkylcarbonamido group having 1 to 20 carbon atoms, an arylcarbonamido group having 7 to 20 carbon atoms, an alkylcarbamoyl group having 1 to 20 carbon atoms, an arylcarbamoyl group having 7 to 20 carbon atoms, an alkylsulfamoyl group having 1 to 20 carbon atoms, an arylsulfamoyl group having 6 to 20 carbon atoms, a hydroxyl group, —COOM, —$SO_3M$ (wherein M is a hydrogen atom, an alkali metal atom, or a substituted or unsubstituted ammonium group), an aryl group having 6 to 20 carbon atoms, an alkylsulfinyl group having 1 to 20 carbon atoms, an arylsulfinyl group having 6 to 20 carbon atoms, and a halogen atom (e.g., F, Cl, Br and I). These groups may be combined together to form a ring.

The alkyl group represented by $R_2$ has preferably 1 to 7 carbon atoms and may be substituted with, for example, the groups such as a halogen atom (e.g., F, Cl, Br and I), a cyano group, —COOM, —$SO_3M$ (wherein M is a hydrogen atom, an alkali metal atom, or a substituted or unsubstituted ammonium group), an alkoxy group having 1 to 20 carbon atoms, a phenyl group, an aryloxy group having 6 to 26 carbon atoms, an alkylthio group having 1 to 20 carbon atoms, a sulfamoyl group having 0 to 20 carbon atoms, a sulfonamide group having 1 to 20 carbon atoms, an alkylcarbonyl group having 1 to 20 carbon atoms, a formyl group, an arylcarbonyl group having 7 to 20 carbon atoms, a hydroxyphenyl group, an alkylcarbonamido group having 1 to 20 carbon atoms, an alkylcarbamoyl group having 1 to 20 carbon atoms, an arylcarbonamido group having 7 to 20 carbon atoms, and an arylcarbamoyl group having 7 to 20 carbon atoms.

The aryl group represented by $R_2$ is mono- or dicyclic and preferably has 6 to 20 carbon atoms, including, for example, a benzene ring. Preferred aryl groups are a phenyl group, a 3,5-dimethanesulfonylphenyl group, a 3,5-dichlorophenyl group, and a 3,5-diethoxy-sym-triazine-2-yl.

The aralkyl group represented by $R_2$ may be substituted with, for example, the groups such as a halogen atom (e.g., F, Cl, Br and I), a cyano group, an alkyl group (preferably having 1 to 20 carbon atoms), —COOM, —$SO_3M$ (wherein M is a hydrogen atom, an alkali metal atom, or a substituted or unsubstituted ammonium group), and an alkylthio group (preferably having 1 to 20 carbon atoms). Preferred aralkyl groups are a 2-hydroxybenzyl group, a 2-hydroxy-5-methoxybenzyl group, and a 2-(pyridine-2-yl)ethyl group.

The alkoxy group represented by $R_2$ preferably has 1 to 8 carbon atoms and may be substituted with, for example, the groups such as a halogen atom (e.g., F, Cl, Br and I) and an aryl group (preferably having 6 to 26 carbon atoms).

The aryloxy group represented by $R_2$ is preferably monocyclic and having 6 to 26 carbon atoms, and may be substituted with, for example, a halogen atom (e.g., F. Cl, Br and I). Preferred alkoxy group are a 3-methoxypropyloxy group and 3-methanesulfonamidoxy group.

In the case where G is a carbonyl group, preferred examples of the groups represented by $R_2$ include a hydrogen atom, a methyl group, an ethoxy group, a trifluoromethyl group, a 3-hydroxypropyl group, a 3-methanesulfonamidopropyl group, a 2-acetylethyl group, a phenyl group, a 3,5-dichlorophenyl group, a 4-methanesulfonylphenyl group, a 3,5-dimethanesulfonylphenyl group, a 3,5-disulfamoylphenyl group, an o-hydroxybenzyl group and an o-methanesulfonamidophenyl group. Particularly preferred is a hydrogen atom.

Preferred amino group represented by $R_2$ are a diethylamino group, a di(2-hydroxyethyl)amino group, a morpholine-1-yl group, a pyridine-1-yl group, imidazol-1-yl group, and a phenylamino group.

In the case where G is a sulfonyl group, preferred examples of the groups represented by $R_2$ include a methyl group, an ethyl group, a phenyl group, a 4-methylphenyl group, an o-hydroxybenzyl group and a 2-acetylethyl group. Particularly preferred is a hydrogen atom.

In the case where G is a sulforyl group, two of the groups represented by $R_2$ are needed. Preferably they are selected from a methoxy group, an ethoxy group, a butoxy group, a phenoxy group and the like. It is preferred that at least one group is a phenoxy group.

In the case where G is a sulfoxy group, preferred examples of the groups represented by $R_2$ include a cyanobenzyl group and a methylthiobenzyl group.

In the case where G is an iminomethylene group, preferred examples of the groups represented by $R_2$ include a methyl group, an ethyl group, and a substituted or unsubstituted phenyl group.

The groups represented by $R_1$ and $R_2$ may contain a so-called ballast group which is often used in photographic additives for diffusion resistance such as a coupler. This ballast group has 8 or more carbon atoms and is a group hardly exerting adverse influences on photographic properties. It is formed by the groups such as an alkyl group, an alkoxy group, a phenyl group, an alkyl-substituted phenyl group, a phenoxy group, an alkyl-substituted phenoxy group and the like.

$R_1$ or $R_2$ may contain a group which accelerates the adsorption of the compound represented by formula (I) onto the silver halide grain surface. For example, such adsorbing groups are groups as described in U.S. Pat. No. 4,385,108 and include a thiourea group (the substituents are those as listed for the above ureido group), a heterocyclic thioamide group represented by the formula:

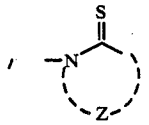

wherein Z is an atomic group necessary to form a 5- or 6-membered hetero ring, a mercaptohetero ring (a 5- or 6-membered hetero ring containing at least one O, N or S atom, which may be condensed to a benzene ring), and a triazolyl group (e.g., a 1,2,3- or 1,2,4-triazolyl group, or a benzotriazole group).

The above substituents (i.e., the substituents for $R_1$, $R_2$, or the above group which accelerates the adsorption of the compound represented by formula (I) onto the silver halide grain) may be further substituted with the groups as listed as the substituents for the aryl group represented by $R_1$.

Most preferred among the groups represented by G is a carbonyl group.

Preferred examples of the group represented by $R_{10}$ and $R_{100}$ include a hydrogen atom, a p-toluenesulfonyl group, a trifluoroacetyl group, an acetyl group, methanesulfonyl group, and 4-oxopentanoyl group. Particularly preferably, $R_{10}$ and $R_{100}$ are both hydrogen atoms.

G, $R_2$, $R_{100}$, and the nitrogen atom to which G, $R_2$ and $R_{100}$ are linked may form a partial structure of hydrazone (—N=C<), provided that though the compounds represented by formula (II) partly include the compounds represented by formula (I), at least one compound which is selected from the compounds represented by formula (II) is not the same with at least one compound which is selected from the compounds represented by formula (I), and the total number of carbon atoms of $R_1$ and $R_2$ is 14 to 60.

More preferred among the compounds represented by formula (II) are the compounds represented by formula (III):

$$R_3\text{-}(L)_n\text{-}Y\text{-}NHNHC(=O)\text{-}R_4 \quad \text{(III)}$$

wherein Y is a substituted or unsubstituted phenylene group; L is —CONH—, —$SO_2$NH—, —O—, —S—, or $$\text{-}N(R_5)CONH\text{-}$$

(wherein $R_5$ is a substituted or unsubstituted alkyl group); n is 0 or 1; $R_3$ is an organic group having 7 or more carbon atoms; and $R_4$ is a hydrogen atom, a substituted or unsubstituted alkyl group, a substituted or unsubstituted phenyl group, a substituted or unsubstituted aralkyl group, a substituted or unsubstituted alkoxy group, or a substituted or unsubstituted phenoxy group.

The formula (III) will hereinafter be explained in detail.

The phenylene group represented by y in formula (III) is an ortho-, meta- or para-phenyl group. In the case where the phenylene group is substituted, preferred examples of the substituents are shown below:

A straight chain, branched chain or cyclic alkyl group (preferably having 1 to 20 carbon atoms), an aralkyl group (preferably mono- or dicyclic, the number of carbon atoms of the alkyl portion being 1 to 3), an alkoxy group or aryloxy group (preferably having 1 to 20 carbon atoms), an amino group having one or two substituents (preferably an alkyl group having 1 to 20 carbon atoms; in the case where two substituents are present, the total number of carbon atoms in the substituents is not more than 20), a sulfamoyl group (preferably having not more than 20 carbon atoms), a carbamoyl group (preferably having 1 to 20 carbon atoms), a substituted or unsubstituted alkylcarbonamido group (preferably having 2 to 30 carbon atoms), a substituted or unsubstituted arylcarbonamido group (preferably having 7 to 30 carbon atoms), a substituted or unsubstituted alkyl or arylsulfone-amide group (preferably having 1 to 30 carbon atoms and 6 to 30 carbon atoms, respectively), an unsubstituted ureido group or a ureido group having one to three substituents (preferably having 1 to 30 carbon atoms), a substituted or unsubstituted aryl group (preferably mono- or dicyclic, having 6 to 30 carbon atoms), a substituted or unsubstituted alkylthio group (preferably having 1 to 30 carbon atoms), a substituted or unsubstituted arylthio group (preferably mono- or dicyclic, having 6 to 30 carbon atoms), a substituted or unsubstituted alkylsulfinyl group (preferably having 1 to 30 carbon atoms), a substituted or unsubstituted arylsulfinyl group (preferably having 6 to 30 carbon atoms), a substituted or unsubstituted alkylsulfonyl group (preferably having 1 to 30 carbon atoms), a substituted or unsubstituted arylsulfonyl group (preferably mono- or dicyclic, having 6 to 30 carbon atoms), a hydroxyl group and a halogen atom.

The above substituents may be further substituted with the groups such as an alkoxy group having 1 to 20 carbon atoms, an aryloxy group having 6 to 20 carbon atoms, an alkylthio group having 1 to 20 carbon atoms, an alkylsulfonyl group having 1 to 20 carbon atoms, an alkylcarbonamido group having 1 to 20 carbon atoms, an arylcarbonamido group having 7 to 20 carbon atoms, an alkylcarbamoyl group having 1 to 20 carbon atoms, an arylcarbamoyl group having 7 to 20 carbon atoms, an alkylsulfamoyl group having 1 to 20 carbon atoms, an arylsulfamoyl group having 6 to 20 carbon atoms, an aryl group having 6 to 20 carbon atoms, an alkylsulfinyl group having 1 to 20 carbon atoms, an arylsulfinyl group having 6 to 20 carbon atoms, a halogen atom (e.g, F, Cl, Br and I), a hydroxy group, —COOM or —$SO_3M$ (wherein M is a hydrogen atom, an alkali metal atom, or a substituted or unsubstituted ammonium group).

Preferred among the organic groups having 7 r more carbon atoms, as represented by $R_3$ are groups having 7 to 30 carbon atoms. Examples of the organic group include a substituted or unsubstituted alkyl group, and a substituted or unsubstituted phenyl group. Examples of substituents for the organic group are described below:

A straight chain, branched chain or cyclic alkyl group (preferably having 1 to 20 carbon atoms), an aralkyl group (preferably mono- or dicyclic, the number of carbon atoms in the alkyl portion of being 1 to 3), an alkoxy group (preferably having 1 to 20 carbon atoms), an amino group having one or two substituents (preferably an alkyl group having 1 to 20 carbon atoms, an acyl group, or an alkyl or arylsulfonyl group; in the case where two substituents are present, the total number of carbon atoms in the substituents is not more than 20), an unsubstituted ureido group or a ureido group having one to three substituents (preferably having 1 to 29 carbon atoms), a substituted or unsubstituted aryl group (preferably mono- or dicyclic, having 6 to 29 carbon atoms), a substituted or unsubstituted arylthio group (preferably having 6 to 29 carbon atoms), a substituted or unsubstituted alkylthio group (preferably having 1 to 29 carbon atoms), a substituted or unsubstituted alkylsulfinyl group (preferably having 1 to 20 carbon atoms), a substituted or unsubstituted arylsulfinyl group (preferably mono- or dicyclic, having 6 to 29 carbon atoms), a substituted or unsubstituted alkylsulfonyl group (preferably having 1 to 29 carbon atoms), a substituted or unsubstituted arylsulfonyl group (preferably mono- or dicyclic, having 6 to 29 carbon atoms), an aryloxy group (preferably mono- or dicyclic, having 6 to 29 carbon atoms), a carbamoyl group (preferably having 1 to 29 carbon atoms), a sulfamoyl group (preferably having 1 to 29 carbon atoms), a hydroxyl group, a halogen atom (e.g., F, Cl, Br and I), a sulfonic acid group, and a carboxylic acid group.

Substituents among the above substituents which can be further substituted may have the following substituents:

An alkyl group (having 1 to 20 carbon atoms), an aryl group (mono- or dicyclic, having 6 to 20 carbon atoms), an alkoxy group (having 1 to 20 carbon atoms), an aryloxy group (having 6 to 20 carbon atoms), an alkylthio group (having 1 to 20 carbon atoms), an arylthio group (having 6 to 20 carbon atoms), an alkylsulfonyl group (having 1 to 20 carbon atoms), an arylsulfonyl group (having 6 to 20 carbon atoms), a carbonamido group (having 1 to 20 carbon atoms), a sulfonamide group (having 0 to 20 carbon atoms), a carbamoyl group (having 1 to 20 carbon atoms), a sulfamoyl group (having 1 to 20 carbon atoms), an alkylsulfinyl group (having 1 to 20 carbon atoms), an arylsulfinyl group (having 1 to 20 carbon atoms), an ester group (having 2 to 20 carbon atoms), a hydroxyl group, —COOM or —$SO_2M$ (wherein M is a hydrogen atom, an alkali metal atom, or a substituted or unsubstituted ammonium group), and a halogen atom (e.g., F, Cl, Br and I). These groups may be bonded together to form a ring. Particularly preferred among the preferred groups represented by $R_3$ are those having a branched alkyl group as a partial structure.

Preferred groups represented by $R_4$ are a hydrogen atom, a substituted or unsubstituted alkyl group having 1 to 20 carbon atoms (particularly preferably having 1 to 10 carbon atoms), a subsittuted or unsubstituted phenyl group having 6 to 20 carbon atoms (particularly preferably having 6 to 15 carbon atoms), a subsituted or unsubstituted aralkyl group having 7 to 20 carbon atoms (particularly preferably having 7 to 15 carbon atoms), a substituted or unsubstituted alkoxy group having 1 to 20 carbon atoms (particularly preferably having 1 to 10 carbon atoms), and a substituted or unsubstituted phenoxy group having 6 to 20 carbon atoms (particularly preferably having 6 to 15 carbon atoms).

The substituents for the group represented by $R_4$ include a hydroxy group, an alkoxy group having 1 to 9 carbon atoms, a sulfonamide group having 0 to 9 carbon atoms, a carbonamide group having 1 to 9 carbon atoms, an ureido group having 1 to 9 carbon atoms and a group having a positive $\sigma$ value of the Hammett's rule such as —F, —Cl, —$SO_2CH_3$, —CN, a sulfamoyl group, a carbamoyl group, etc.

Representative examples of the compounds represented by formula (II) are shown below, although the present invention is not intended to be limited thereto.

II-1

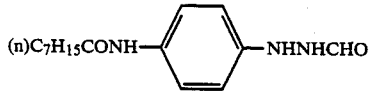

-continued
II-2
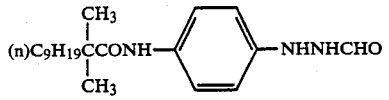
II-3
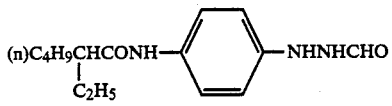
II-4
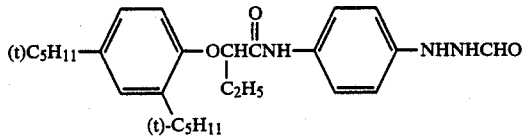
II-5
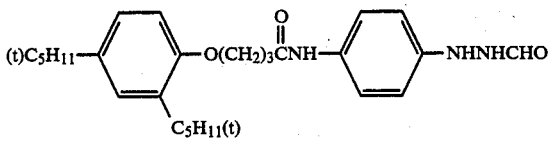
II-6
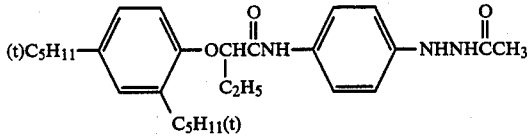
II-7
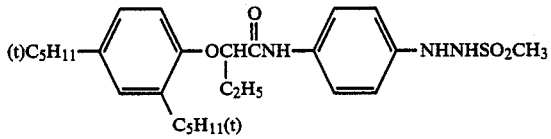
II-8
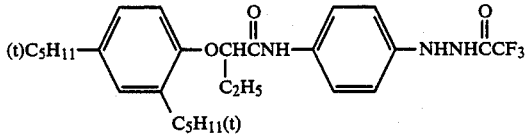
II-9
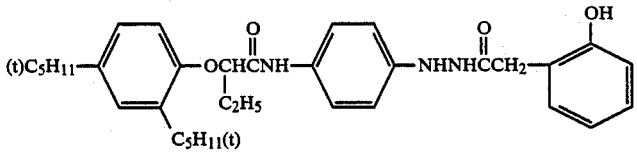
II-10
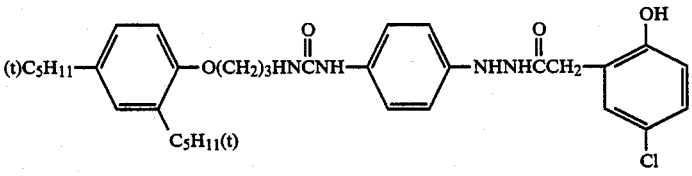
II-11
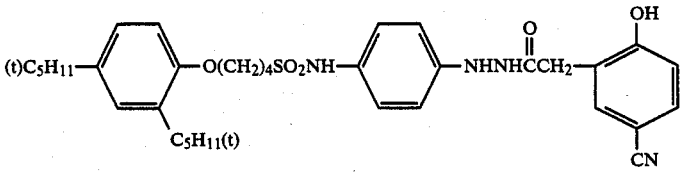

-continued
II-12
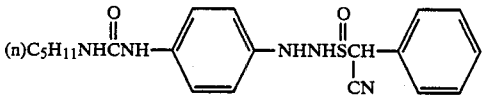
II-13
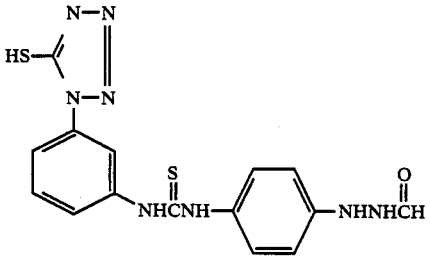
II-14
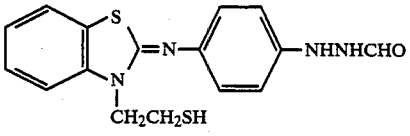
II-15
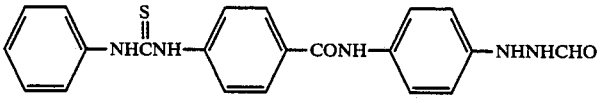
II-16
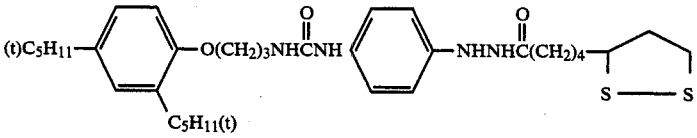
II-17
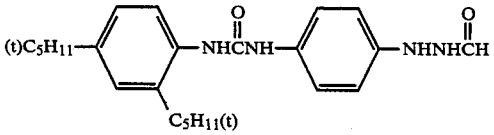
II-18
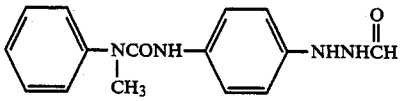
II-19
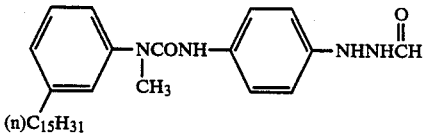
II-20
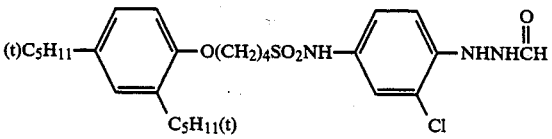
II-21
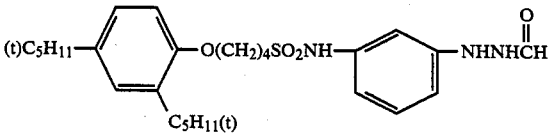

-continued
II-22
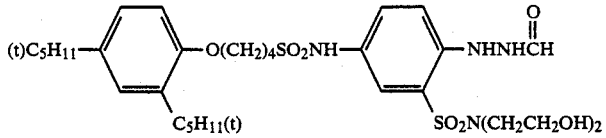
II-23
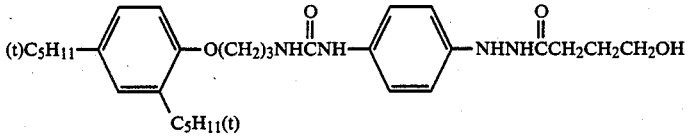
II-24
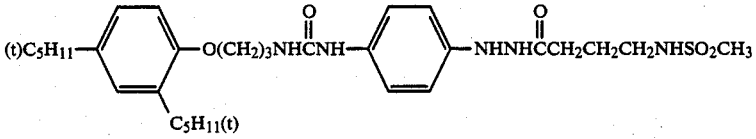
II-25
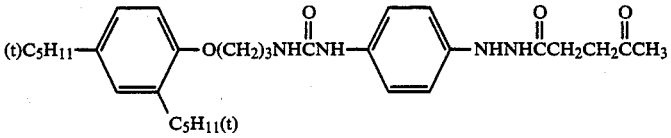
II-26
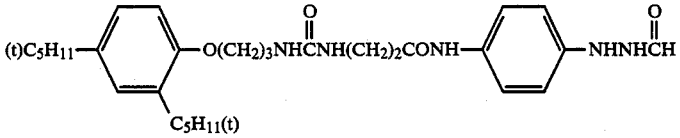
II-27
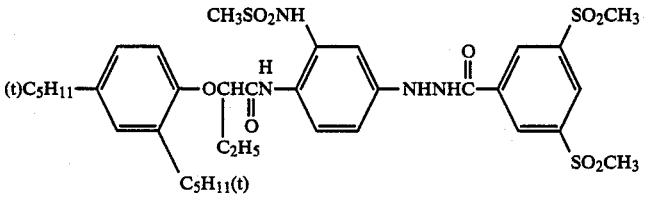
II-28
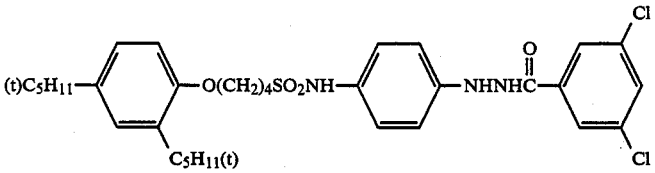
II-29
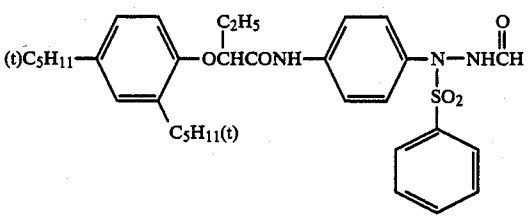
II-30
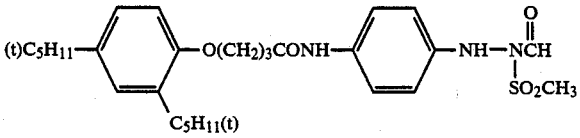
II-31
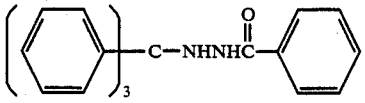

-continued

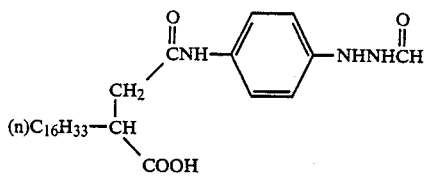

II-32

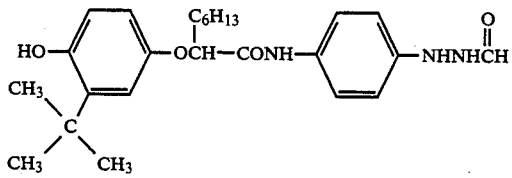

II-33

A method of synthesis of the compounds of the formulae (I) and (II) will hereinafter be explained with reference to the following synthetic examples. The compounds of the present invention can be synthesized referring to, for example, Japanese Patent Application (OPI) Nos. 67843/81, 20921/78, 20922/78, 66732/78, 20318/78, 179734/85, 179734/85, 11459/85, and 115036/86, and U.S. Pat. No. 4,560,638.

SYNTHETIC EXAMPLE 1

Preparation of Compound I-4

(1) Preparation of 2-[4-[3-(3-Nitrophenyl)ureido]phenyl]-1-formylhydrazine 200 ml of acetonitrile and 200 ml of N,N-dimethylformamide were added to 60.4 g of 2-(4-aminophenyl)-1-formylhydrazine to dissolve it therein, and the resulting solution was cooled to −5° C. 65.6 g of metanitrophenyl isocyanate dissolved in 200 ml of acetonitrile was added dropwise. During this period, the mixture was stirred while cooling so that the temperature did not exceed −5° C. In addition, 300 ml of acetonitrile was added, and the resulting mixture was stirred at 0° C. for 3 hours. Crystals formed were filtered off and wash with acetonitrile and then washed with methanol. The crystals thus obtained were dissolved in 1 liter of N,N-dimethylformamide. An insoluble portion was filtered off. To the filtrate, 3 liters of methanol was added, and the resulting solution was cooled to thereby form crystals. These crystals were filtered off and washed with acetonitrile and then washed with methanol. The yield was 98.5 g.

(2) Preparation of 2-[4-[3-(3-Aminophenyl)ureido]phenyl-1-formylhydrazine 138 g of iron powder, 5 g of ammonium chloride, 2.45 liters of dioxane and 985 ml of water were mixed, and heated and stirred on a steam bath. 98 g of the nitro compound obtained in (1) above was added, and the resulting mixture was refluxed for 40 minutes. Insoluble materials were removed by filtration. The filtrate was concentrated under reduced pressure and then water was added therein. Crystals formed were filtered off and washed by pouring with acetonitrile. The yield was 79 g.

(3) Preparation of Compound I-4

4 g of the amino compound obtained in (2) above was dissolved in 20 ml of N,N-dimethylacetamide. Then, 20 ml of acetonitrile and 1.4 g of triethylamine were added, and the resulting mixture was cooled to −5° C. Then, 4,4 g of (2,4-di-tert-pentylphenoxy)acetyl chloride was added dropwise. During this period, the mixture was stirred while cooling so that the temperature of the liquid did not exceed 0° C. Subsequently the mixture was stirred for 1 hour at 0° C. and stirred for 2 hours at room temperature, and then 800 ml of water was added to precipitate crystals. The crystals were filtered off and recrystallized from acetonitrile. The yield was 4.8 g, and the melting point was 152° to 154° C.

SYNTHETIC EXAMPLE 2

Preparation of Compound I-5

60 ml of N,N-dimethylacetamide, 60 ml of acetonitrile and 4.01 g of triethylamine were added to 11.4 g of the amino compound obtained in (2) of Preparation Example 1, and the resulting mixture was cooled to 0° C., 13.5 g of 4-(2,4-di-tert-pentylphenoxy)butyloyl chloride was added dropwise. During this period, the mixture was stirred while cooling so that the temperature of the liquid did not exceed 5° C. Subsequently the mixture was stirred for 1.5 hours, and water was added to crystallize crystals. The crystals were filtered off and recrystallized from acetonitrile. The yield was 11.2 g, and the melting point was 207° to 209° C.

SYNTHETIC EXAMPLE 3

Preparation of Compound I-15

300 ml of N,N-dimethylacetamide, 30 ml of triethylamine and 58.3 g of 3-(2,4-di-tert-pentylphenoxy)-propylamine were added to 54.2 g of 2-(4-phenoxycarbonylaminophenyl)-1-formylhydrazine synthesized from phenyl chloroformate and 2-(4-aminophenyl)-1-formylhydrazine, and the resultant mixture was heated and stirred for 1 hour at 60° C. The mixture was cooled to 30° C. and then poured into a mixture of 900 ml of 0.5 mol/l of hydrochloric acid and 700 ml of ethyl acetate. An organic layer was separated and condensed, and dissolved in 350 ml of acetonitrile. Then, 1 liter of water was added, and crystals formed were filtered off and washed by pouring with water. The crystals were dissolved in 600 ml of acetonitrile by heating. 3 g of active carbon was added, and then the solution was filtered off while it was hot. The filrate was cooled to room temperature and then stirred for 1 hour. Then it was cooled with ice and stirred until the inner temperature reached 5° C. Crystals formed were filtered off and washed by pouring with 150 ml of acetonitrile. The yield was 69.2 g, and the melting point was 158° to 160° C.

The compounds of the formulae (I) and (II) which are used in the present invention can be added to the same layer (e.g., an emulsion layer) or different layers (e.g., an emulsion layer and a hydrophilic layer). The amount of the compound of the formula (I) to be added is $1\times10^{-6}$ to $1\times10^{-2}$ mol, preferably $1\times10^{-5}$ to $1\times10^{-3}$ mol per mol of silver of the silver halide photographic material. The amount of the compound of the formula (II) to be added is $1\times10^{-5}$ to $1\times10^{1}$ mol, preferably $1\times10^{-4}$ to $1\times10^{-2}$ mol per mol of silver of the photographic material. The molar ratio of the compound of the formula (I) to the compound of the formula (II) is preferably 1/20 to 10/1 and more preferably 1/10 to 5/1.

In incorporating the compound of the formula (I) or (II) in the photographic material, the compound is added to a hydrophilic colloid solution either in the form of a solution in organic solvents compatible with water, such as alcohols (e.g., methanol and ethanol), esters (e.g., ethyl acetate) and ketones (e.g., acetone), or when soluble in water, in the form of an aqueous solution.

When the compound of the formula (I) or (II) is added to the photographic emulsion, it may be added at any desired point from the start of chemical ripening to before coating, preferably before the completion of chemical ripening.

In the silver halide emulsion which is used in the present invention, any of silver chloride, silver chlorobromide, silver iodobromide, silver iodochlorobromide and the like can be used. Silver halide containing not less than 70 mol%, especially not less than 90 mol% of silver bromide is preferred. The silver ioide content is preferably not more than 10 mol% and particularly preferably 0.1 to 5 mol%.

The average grain size of silver halide to be used in the present invention is preferably as fine as not more than 0.7 micron and particularly preferably not more than 0.5 micron. There are no special limitations to the grain size distribution, but monodisperse is preferred. The term "monodisperse" as used herein means that either by total weight or number of silver halide grains, at least 95% of grains is included in the size range within ±40% of the average grain size.

Silver halide grains in the photographic emulsion may be grains having a regular crystal form, such as cubic and octahedral, or grains having an irregular crystal form, such as spherical or tabular, or grains having a composite crystal form thereof.

Silver halide grains may be such that the inner portion and the surface layer are of the homogeneous phase, or such that the inner portion and the surface layer are of heterogeneous phases. Two or more silver halide emulsions prepared independently can be used in admixture with each other.

In the silver halide emulsion which is used in the present invention, in the course of formation or physical ripening of the silver halide grains, cadmium salts, sulfurous acid salts, lead salts, thallium salts, rhodium salts or its complex salts, iridium salts or its complex salts and the like may be allowed to coexist.

A particularly suitable silver halide for use in the present invention is silver haloiodide which is prepared in the presence of $1\times10^{-8}$ to $1\times10^{-5}$ mol per mol of silver of iridium salts or its complex salts, and the silver iodide content of the surface of which is greater than the average silver iodide content. If an emulsion containing such a silver haloiodide is used, photographic characteristics of higher sensitivity and high gamma value can be obtained.

The silver halide emulsion which is used in the method of the present invention may be or may not be subjected to chemical sensitization. As methods of chemical sensitization of the silver halide emulsion, sulfur sensitization, reduction sensitization and gold metal sensitization are known. These methods can be employed alone or in combination with each other.

A typical example of the noble metal sensitization method is a gold sensitization method in which gold compounds, mainly gold complex salts are used. In addition to gold, complex salts of other noble metals such as platinum, rhodium and palladium can be used. Representative examples are described in U.S. Pat. No. 2,448,060 and British Patent 618,061.

As sulfur sensitizers, as well as sulfur compounds contained in gelatin, various sulfur compounds such as thiosulfuric acid salts, thioureas, thiazoles and rhodanines can be used.

In the above case, it is preferred that the above specified amount of iridium salts is added before the completion of physical ripening in the process of production of the silver halide emulsion, particularly at the time of formation of the grains.

The iridium salts are water-soluble iridium salts or iridium complex salts. Examples of the salts include iridium trichloride, iridium tetrachloride, potassium hexachloroiridate (III), potassium hexachloroiridate (IV), and ammonium hexachloroiridate.

It is preferred for the silver halide emulsion layer of the present invention to contain two kinds of monodisperse emulsions having average grain sizes as described in Japanese Patent Application (OPI) No. 223734/86 and Japanese Patent Application No. 232086/85 (corresponding to U.S. patent application Ser. No. 918,443 filed on Oct. 14, 1986) in that the maximum density (Dmax) can be increased. In this case, it is preferred that the small size monodisperse grains be chemically sensitized. For this chemical sensitization, the sulfur sensitization is the most preferred. The large size monodisperse emulsion may be or may not be subjected to chemical sensitization. Since the large size monodisperse grains are generally liable to cause the formation of black pepper, it is usually not subjected to chemical sensitization. In application of the chemical sensitization, therefore, it is particularly preferred that the chemical sensitization be applied to such an extent as not to cause the formation of black pepper. In order to apply the chemical sensitization to such an extent as not to cause the formation of black pepper, the time for the chemical sensitization is shortened, the temperature is decreased, or the amount of the chemical sensitizer to be used is decreased. There are no special limitations to the difference in sensitivity between the large size monodisperse emulsion and the small size monodisperse emulsion. However, $\Delta \log E$ is preferably 0.1 to 1.0 and more preferably 0.2 to 0.7. It is preferred for the sensitivity of the large size monodisperse emulsion to be higher than that of the small size monodisperse emulsion. The sensitivity of each emulsion is a value as determined by coating on a support the emulsion with a hydrazine derivative incorporated therein, and processing it with a developer containing not less than 0.15 mol/l of sulfite ions and having a pH of 10.5 to 12.3.

The average grain size of the small size monodisperse emulsion grains is not more than 90% of the average size of the large size monodisperse emulsion grains, with a range of not more than 80% being preferred. The average grain size of silver halide emulsion grains is preferably 0.02 to 1.0 micron and more preferably 0.1 to 0.5 micron. It is preferred that the average grain size of both the large size and small size monodisperse grains fall within the above specified range.

In the case where two or more emulsions having different sizes are used in the present invention, the amount of silver (silver content) in the small size monodisperse emulsion coated is preferably 40 to 90 wt%, and more preferably 50 to 80 wt% based on the total amount of silver coated.

In incorporating monodisperse emulsions having different grain sizes, the emulsions may be added to the same layer or to different layers. When they are incorporated in different layers, it is preferred that the large size emulsion be incorporated in the upper layer and the small size emulsion be incorporated in the lower layer.

The total amount of silver coated is preferably 1 to 8 $g/m^2$.

To the light-sensitive material to be used in the present invention, for the purpose of increasing the sensitivity, sensitizing dyes as described in U.S. Pat. No. 4,243,739 such as cyanine dyes and merocyanine dyes, can be added.

These sensitizing dyes may be used alone or in combination with each other. Combinations of sensitizing dyes are often used particularly for the purpose of super sensitization. In combination with sensitizing dyes, dyes not having the spectral sensitization action by themselves, or substances not substantially absorbing visible light but exhibiting super sensitization may be added to the emulsion.

Useful sensitizing dyes, combinations of sensitizing dyes exhibiting super sensitization, and substances exhibiting super sensitization are described in Research Disclosure, Vol. 176, RD No. 17643 (December 1978), page 23, Clause IV-J.

To the light-sensitive material of the present invention, various compounds can be added for the purposes of preventing fog or stabilizing photographic performance during the process of production, storage or photographic processing of the light-sensitive material. For example, many compounds known as antifoggants or stabilizers, e.g., azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitobenzotriazoles; mercaptopyrimidines; mercaptotriazines; thioketo compounds such as oxazolinethione; azaindenes such as triazaindenes, tetrazaindenes (particularly 4-hydroxy-substituted (1,3,3a,7)tetrazaindenes) and pentazaindenes; benzenesulfonic acid, benzenesulfonic acid, and benzenesulfonic acid amide can be added. Of these compounds, benzotriazoles (e.g., 5-methylbenzotriazole) and nitroindazoles (e.g., 5-nitroindazole) are preferred. These compounds may be incorporated in the processing solution.

In the photographic material of the present invention, inorganic or organic hardeners may be added to the photographic emulsion or other hydrophilic colloid layer. For example, chromium salts (e.g., chromium alum and chromium acetate), aldehydes (e.g., formaldehyde, glyoxal and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloylhexahydro-s-triazine and 1,3-vinylsulfonyl-2-propanol), active halogen compounds (e.g., 2,4-dichloro-6-hydroxy-s-triazine), mucohalogenic acids (e.g., mucochloric acid and mucophenoxychloric acid) and the like can be used alone or in combination with each other.

The photographic emulsion layer or other hydrophilic colloid layer of the light-sensitive material prepared by the present invention may contain various surface active agents for various purposes such as, e.g., coating aids, antistatic agent or for improving sliding, accelerating emulsification and dispersion, preventing adhesion and improving photographic characteristics (e.g., acceleration of development, increasing the contrast, and sensitization). For example, nonionic surface active agents such as saponin (steroid-based), alkylene oxide derivatives (e.g., polyethylene glycol, polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or amides, and the polyethylene oxide adducts of silicone), glycidol derivatives (e.g., alkenylsuccinic acid polyglyceride and alkylphenyl polyglyceride), fatty acid esters of polyhydric alcohols, alkylesters of sugar, etc.; anionic surface active agents containing an acidic group, e.g., a carboxyl group, a sulfo group, a phospho group, a sulfuric acid ester group and a phosphoric acid ester group, such as alkylcarboxylic acid salts, alkylsulfonic acid salts, alkylbenzenesulfonic aciad salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters; amphoteric surface active agents such as amino acids, aminoalkylsulfonic acids, aminoalkylsulfuric acid or phosphoric acid esters, alkylbetaines, amine oxides, etc.; and cationic surface active agents such as alkylamines, aliphatic or aromatic quaternary ammonium salts, heterocyclic quaternary ammonium salts such as pyridinium and imidazolium, aliphatic or hetero ring-containing phosphonium or sulfonium salts, etc. can be used.

Surface active agents preferably used in the present invention are polyalkylene oxides having a molecular weight of not less than 600 as described in U.S. Pat. No. 4,221,857. When used as antistatic agents, fluorine-containing surface active agents (as described in U.S. Pat. No. 4,201,586, Japanese Patent Application (OPI) Nos. 80849/85 and 74554/84) are particularly preferred.

In the photographic material of the present invention, the photographic emulsion layer or other hydrophilic colloid layer can contain matting agents such as silica, magnesium oxide and polymethyl methacrylate for the purpose of preventing adhesion.

To the photographic emulsion of the present invention, for the purpose of improving dimensional stability, a dispersion of water-insoluble or sparingly water-soluble synthetic polymers can be added. For example, homo- or copolymers of alkyl acrylate or methacrylate, alkoxyacryl acrylate or methacrylate, glycidyl acrylate or methacrylate and the like, and copolymers of the above monomers and monomers such as acrylic acid and methacrylic acid can be used.

It is preferred for the silver halide emulsion layer and other layers of the photographic material of the present invention to contain compounds having an acidic group. Examples of such acidic group-containing compounds include polymers or copolymers having as repeating units organic acids such as salicylic acid, acetic acid and ascorbic acid and acid monomers such as acrylic acid, maleic acid and phthalic acid. In connection with these compounds, Japanese Patent Application (OPI) Nos. 228437/86 and 223834/86, and Japanese Patent Application Nos. 163856/85 and 195655/85 (corresponding to U.S. patent application Ser. No. 904,062 filed on Sept. 4, 1986) can be referred to. Particularly preferred among these compounds are, as low molecular weight compounds, ascorbic acid and, as high molecular weight compounds, a water-dispersed latex of copolymers composed of such as acid monomers such as acrylic acid, and cross-linking monomers having two or more unsaturated groups, such as divinylbenzene.

As a binder or protective colloid to be used in the light-sensitive material, it is advantageous to use gelatin. In addition, other hydrophilic synthetic polymers and the like can also be used. As the gelatin, lime-processed gelatin, acid-processed gelatin, derivative gelatin and the like can be used. More specifically they are described in *Research Disclosure,* Vol. 176, RD No. 17643 (December 1978), Clause IX.

To obtain photographic characteristics of high sensitivity and high contrast using the silver halide photographic material of the present invention, the conventional infectious developer and the high alkali developer having a pH as high as 13 as described in U.S. Pat. No. 2,419,975 do not necessarily need to be used, and a stable developer can be used.

The silver halide light-sensitive material of the present invention can provide a super high contrast negative image upon development using a developer containing at least 0.15 mol/l of sulfite ions as preservatives and having a pH of 10.5 to 12.3, especially 11.0 to 12.0.

There are no special limitations on the developing agents to be used in the developer as used herein. It is preferred that dihydroxybenzenes be present in that good dot quality can be easily obtained. Combinations of dihydroxybenzenes and 1-phenyl-3-pyrazolidones, or combinations of dihydroxybenzenes and p-aminophenols can also be used.

Dihydroxybenzenes developing agents which can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Of these compounds, hydroquinone is particularly preferred.

1-Phenyl-3-pyrazolidone or its derivative developing agents which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

p-Aminophenol-based developing agents which can be used in the present invention include N-methyl-p-aminophenol, p-aminophenol, N-(β-hydroxyethyl)-p-aminophenol, N-(4-hydroxyphenyl)glycine, 2-methyl-p-aminophenol, p-benzyl-aminophenol and the like. Of these compounds, N-methyl-p-aminophenol is particularly preferred.

The amount of the developing agent used is preferably 0.05 to 0.8 mol/l. In a case where a combination of dihydroxybenzenes and 1-phenyl-3-pyrazolidones or p-aminophenols is used, it is preferred that the amount of the former dihydroxybenzenes used be 0.05 to 0.5 mol/l and the amount of the latter 1-phenyl-3-pyrazolidones or p-aminophenols used be not more than 0.06 mol/l.

Sulfurous acid salts (i.e., sulfites) as preservatives which can be used in the present invention include sodium sulfite, potassium sulfite, lithium sulfite, ammonium sulfite, sodium hyposulfite, potassium metahydrosulfite, and sodium formaldehyde hyposulfite. The amount of the sulfurous acid salt used is preferably not less than 0.4 mol/l and particularly preferably not less than 0.5 mol/l. The upper limit is preferably 2.5 mol/l.

Alkali agents which can be used to adjust the pH include pH adjustors or buffers such as sodium hydroxide, potassium hydroxide, sodium carbonate, potassium carbonate, sodium triphosphate, and potassium triphosphate.

Additives which can be used in addition to the above components include development inhibitors, e.g., boric acid, compounds such as borax, sodium bromide, potassium bromide and potassium iodide; organic solvents such as ethylene glycol, diethylene glycol, triethylene glycol, dimethylformaldehyde, methyl cellosolve, hexylene glycol, ethanol and methanol; and antifoggants or black pepper-preventing agents, e.g., mercapto compounds such as 1-phenyl-5-mercaptotetrazole and 2-mercaptobenzimidazole-5-sulfonic acid sodium salt, indazole compounds such as 5-nitroindazole, and benztriazole compounds such as 5-methylbenztriazole. In addition, if desired, a color adjustor, a surface active agent, a defoaming agent, a hard water softening agent, a hardener and amino compounds as described in U.S. Pat. No. 4,269,929 can be added.

As a fixer, an aqueous solution containing water-soluble aluminum compounds, acetic acid and dibasic acaids (e.g., tartaric acid, citric acid or salts thereof) and having a pH of not less than 4, preferably 4.4 to 5.0 can be used.

The fixing agent contains as essential components thiosulfuric acid ions and ammonium ions, such as ammonium thiosulfate. From the viewpoint of fixing speed, ammonium thiosulfate is particularly preferred. The amount of the fixing agent used can be varied. In general, the amount of the fixing agent used is from about 0.1 to 5 mol/l.

Water soluble aluminum salts which act as hardeners in the fixer are generally known compounds as hardeners for acidic hardening fixing agents. Examples are aluminum chloride, aluminum sulfate and potash alum.

The supports which can be used in the present invention are generally known supports.

The present invention is described below in greater detail with reference to the following examples although it is not intended to be limited thereto.

Unless otherwise indicated, all percents, ratios, etc., are by weight.

EXAMPLE 1

Emulsions (A) and (B) were prepared as follows.

Emulsion (A)

An aqueous solution of silver nitrate and an aqueous solution of potassium iodide and potassium bromide were added at the same time to an aqueous solution of gelatin maintained at 50° C. in the presence of $4\times10^{-7}$ mol per mol of silver of iridium hexachloride and ammonia over 60 minutes. During this process, the pAg was maintained at 7.8 to prepare a cubic monodisperse emulsion having an average grain diameter of 0.3 microns and an average silver iodide content of 1 mol%.

Emulsion (B)

Following the method for the preparation of Emulsion (A), the amounts of potassium iodide and ammonia were changed to prepare a cubic monodisperse emulsion having an average grain diameter of 0.22 micron and an average silver iodide content of 0.1 mol%.

For both Emulsions (A) and (B), salts were removed by the flocculation method. In connection with Emulsion (B), sulfur sensitization using sodium thiosulfate was applied to obtain a sulfur sensitized emulsion having an average grain diameter of 0.22 micron, and an average silver iodide content of 0.1 mol%.

To these silver iodobromide emulsions, the sodium salt of 5,5'-dichloro-9-ethyl-3,3'-bis(3-sulfopropyl)oxacarbocyanine as a sensitizing dye, 4-hydroxy-6-methyl-1,3,3a,7-tetrazaindene as a stabilizer, an aqueous latex (a) having the following structure formula:

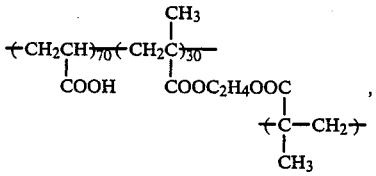

a dispersion of polyethyl acrylate and 1,3-divinylsulfonyl-2-propanol were added. Then thus-obtained Emulsions (A) and (B) were mixed in a silver halide weight ratio of ¼. In addition, the compounds of the formulae (I) and (II) of the present invention were added in the amounts shown in Table 1. Then the resultant mixture was coated on a polyethylene terephthalate film in a silver amount of 3.4 g/m². Each sample was exposed and developed, and measured for photographic characteristics. The results are shown in Table 1.

A developer having the following formulation was used.

| Formulation of Developer | |
|---|---|
| Hydroquinone | 45.0 g |
| N—Methyl-p-aminophenol ½ sulfate | 0.8 g |
| Sodium hydroxide | 18.0 g |
| Potassium hydroxide | 55.0 g |
| 5-Sulfosalycilic acid | 45.0 g |
| Boric acid | 25.0 g |
| Potassium sulfite | 110.0 g |
| Disodium ethylenediaminetetraacetate | 1.0 g |
| Potassium bromide | 6.0 g |
| 5-Methylbenzotriazole | 0.6 g |
| n-Butyldiethanolamine | 15.0 g |
| Water to make | 1000 ml |
| | (pH = 11.60) |

As the comparative compound (A), the following was used.

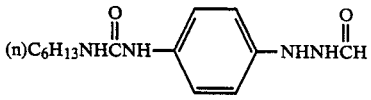

TABLE 1

| No. | Compound of Formula (I) Type | Compound of Formula (I) Amount (mol/mol Ag) | Compound of Formula (II) Type | Compound of Formula (II) Amount (mol/mol Ag) | Photographic Characteristic 1 Sensitivity | Photographic Characteristic 1 γ | Photographic Characteristic 2 Sensitivity | Photographic Characteristic 2 γ | Photographic Characteristic 3 Sensitivity | Photographic Characteristic 3 γ | Remarks |
|---|---|---|---|---|---|---|---|---|---|---|---|
| 1 | I-15 | $2 \times 10^{-4}$ | — | — | 100 | 14.5 | 93 | 12.7 | 78 | 8.5 | |
| 2 | " | $3 \times 10^{-4}$ | — | — | 112 | 17 | 107 | 15.0 | 91 | 11.0 | |
| 3 | — | — | II-4 | $2 \times 10^{-3}$ | 100 | 16.5 | 79 | 9.0 | 91 | 14.5 | |
| 4 | — | — | " | $4 \times 10^{-3}$ | 110 | 17.5 | 93 | 10.5 | 117 | 15.0 | |
| 5 | I-15 | $1 \times 10^{-4}$ | I-4 | $1 \times 10^{-4}$ | 100 | 14.5 | 93 | 12.5 | 78 | 8.4 | |
| 6 | " | " | " | $1.5 \times 10^{-4}$ | 106 | 15.5 | 99 | 13.5 | 83 | 96 | |
| 7 | " | $1.5 \times 10^{-4}$ | " | $1 \times 10^{-4}$ | 107 | 15.5 | 100 | 13.5 | 84 | 97 | |
| 8 | " | " | " | $1.5 \times 10^{-4}$ | 112 | 16.5 | 106 | 14.5 | 90 | 11.0 | |
| 9 | Comparative Compound (A) | $1.5 \times 10^{-4}$ | II-4 | $4 \times 10^{-4}$ | 102 | 18.0 | 99 | 15.5 | 97 | 16.5 | |
| 10 | Comparative Compound (A) | " | " | $5 \times 10^{-4}$ | 107 | 18.5 | 101 | 17.0 | 101 | 17.0 | |
| 11 | Comparative Compound (A) | $2 \times 10^{-4}$ | " | $1 \times 10^{-4}$ | 112 | 19.0 | 104 | 15.5 | 105 | 17.0 | |
| 12 | Comparative Compound (A) | " | " | $2 \times 10^{-4}$ | 120 | 19.5 | 113 | 16.0 | 107 | 17.0 | |
| 13 | II-5 | $1 \times 10^{-3}$ | II-4 | $1 \times 10^{-3}$ | 102 | 16.5 | 80 | 9.0 | 92 | 14.5 | |
| 14 | " | $2 \times 10^{-3}$ | " | $2 \times 10^{-3}$ | 111 | 17.5 | 94 | 10.5 | 118 | 15.0 | |
| 15 | " | $1.5 \times 10^{-4}$ | " | $5 \times 10^{-4}$ | 85 | 10.0 | 70 | 8.0 | 80 | 9.0 | |
| 16 | " | $5 \times 10^{-4}$ | " | $1.5 \times 10^{-4}$ | 86 | 10.0 | 71 | 8.0 | 80 | 9.0 | |
| 17 | I-15 | $1.5 \times 10^{-4}$ | II-4 | $4 \times 10^{-4}$ | 100 | 18.0 | 98 | 15.5 | 98 | 16.5 | Invention |
| 18 | " | " | " | $5 \times 10^{-4}$ | 105 | 18.5 | 100 | 17.0 | 102 | 17.0 | " |
| 19 | " | $2 \times 10^{-4}$ | " | $1 \times 10^{-4}$ | 110 | 19 | 102 | 15.5 | 107 | 17.0 | " |
| 20 | " | " | " | $2 \times 10^{-4}$ | 117 | 19.5 | 110 | 16.0 | 110 | 17.0 | " |
| 21 | I-19 | $4.5 \times 10^{-4}$ | " | $5 \times 10^{-4}$ | 102 | 18.0 | 97 | 15.0 | 100 | 17.5 | " |

Photographic Characteristic 1:

The results were obtained when the film which had been stored for 1 day after coating was processed at 38° C. for 30 seconds by the use of an automatic developing machine FG660F (manufactured by Fuji Photo Film Co., Ltd.). The relative sensitivity is a relative value of the reciprocal of an exposure amount to provide a density of 1.5 upon development at 38° C. for 30 seconds, with that of Sample 1 as 100.

Photographic Characteristic 2:

The results were obtained when the processing was performed in the same manner as above, but using a developer which had been used in processing 200 sheets of Fuji GO-100 Film (size: 50.8 cm×61.0 cm) which had been entirely exposed to light.

Photographic Characteristic 3:

The results were obtained when the film which had been stored for 3 days under the conditions of a temperature of 50° C. and a relative humidity of 75% was processed in the same manner as in the case of Photographic Characteristic 1.

As is apparent from the results in Table 1, in comparison with Comparative Samples 1 to 8 and 13 to 16 in which compounds of the formula (I) or (II) were used alone, the compounds of the formula (I) were used in combination or the compounds of the formula (II) were used in combination, Samples 17 to 21 of the present invention are obtained excellent results that in the low activity processing solution (Photographic Characteristic 2) and the forced deterioration test (Photographic Characteristic 3), reductions in sensitivity and gradation (γ) were small.

Comparative Samples 9 to 12 in which the comparative compound (A) was used exhibited similar performance to the samples of the present invention, but had a serious disadvantage of readily causing deterioration of the processing solution as shown below and thus is unsuitable for practical use.

A Fuji Scanner Film LS-500 (for rapid access) was exposed and then developed and fixed by the use of a FG-660F automatic developing machine (manufactured by Fuji Photo Film Co., Ltd.) using a processing solution which had been used in processing 1,000 sheets of film (size: 252 mm×302 mm) which had been exposed so as to blacken by 50% of the total area of Sample 19 (the present invention) or Sample 11 (containing the comparative compound A). Then the photographic performance was evaluated. The developing time was 30 seconds at 38° C.

TABLE 2

| | Developer | Photographic Characteristics of LS-500 Sensitivity | γ | Fog |
|---|---|---|---|---|
| 2-1 | Fresh Solution | 100 (base) | 5.5 | 0.05 |
| 2-2 | Developer after development processing of Sample 11 | 109 | 7.5 | 0.06 |
| 2-3 | Developer after development processing of Sample 19 | 100 | 5.5 | 0.05 |

As is apparent from the results in Table 2, in the case where a processing solution after the development processing with Sample 19 of the present invention is used, almost no change in sensitivity, gamma value and fog was observed as compared with a fresh solution not used in the processing. In connection with photographic characteristics after the development processing with Comparative Sample 11, the sensitivity, gamma value or fog was increased as compared with the case where a fresh solution was used. It can be seen therefore that samples produced in accordance with the present invention are greatly reduced in the deterioration of the processing solution.

REFERENCE EXAMPLE 1

Samples 2 to 9 were prepared by adding a compound of the formula (I) or (II) and Comparative Compounds (B) and (C) in an amount of $3\times10^{-3}$ mol per mol of silver to an emulsion prepared in the same manner as in Example 1. With these samples, 200 sheets of film (size: 252 mm×302 mm) were processed. A Fuji scanner film LS-500 (for rapid access) was exposed, and the developed and fixed by the use of a FG-660F automatic developing machine (manufactured by Fuji Photo Film Co., Ltd.) to evaluate photographic characteristics. Sample 3-1 indicates the photographic performance of a fresh solution with which 200 sheets of film were not processed. As is apparent from the results of Table 3, when the processing was conducted with Samples 3-2 to 3-7 containing the compounds of the present invention, there was almost no change in sensitivity, gamma value or fog. On the other hand, in connection with photographic characteristics after the processing with the Comparative Samples (Samples 3-8 and 3-9), the sensitivity, gamma value or fog was increased as compared with Sample 3-1. Accordingly, it can be seen that the specified compounds of the present invention are greatly reduced in the deterioration of the processing solution as compared with the similar compounds.

Comparative Compound (B)

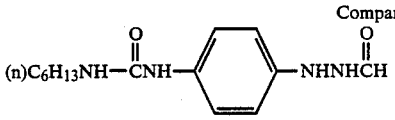

Comparative Compound (C)

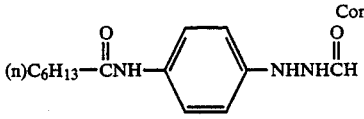

TABLE 3

| Sample | Compound of Formula (I) or (II) or Comparative Compound (B) or (C) | Photographic Characteristics Sensitivity | γ | Fog | |
|---|---|---|---|---|---|
| 3-1* | — | 100 (base) | 5.5 | 0.05 | Compound of the present invention |
| 3-2 | (I)-2 | 102 | 5.7 | 0.05 | |
| 3-3 | (I)-4 | 100 | 5.5 | 0.05 | |
| 3-4 | (I)-15 | 100 | 5.5 | 0.05 | |
| 3-5 | (II)-3 | 101 | 5.6 | 0.05 | |
| 3-6 | (II)-4 | 100 | 5.5 | 0.05 | |
| 3-7 | (II)-5 | 100 | 5.5 | 0.05 | |
| 3-8 | (B) | 107 | 8 | 0.06 | Similar compounds not falling within the scope of the present invention |
| 3-9 | (C) | 120 | 9 | 0.07 | |

*Photographic performance of a fresh solution not used in the processing of 200 sheets of film is shown.

EXAMPLE 2

To the silver iodobromide emulsion (A) prepared in Example 1, the sodium salt of 5,5'-dichloro-9-ethyl-3,3'-bis(3-sulfopropyl)oxacarbocyanine as a sensitizing dye, 4-hydroxy-6-methyl-1,3,3a,7-tetraazaindene as a stabilizer, a dispersion of polyethyl acrylate, an aqueous latex (a) represented by the structural formula shown below, 1,3-divinylsulfonyl-2-propanol, and compounds of the formulae (I) and (II) in the amounts shown in Table 4 were added. The resulting mixture was coated on a polyethylene terephthalate film so that the amount of silver coated was 3.2 g/m. Each sample was exposed and developed in the same manner as in Example 1 to determine its photographic characteristics. The results are shown in Table 4.

Aqueous Latex (a)

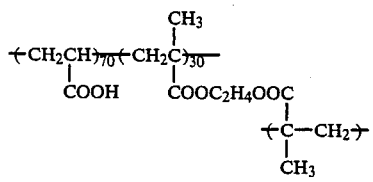

As is apparent from the results of Table 4, Samples 26 to 30 of the present invention are excellent in photographic characteristics 1 to 3 as compared with Comparative Samples 22 to 25.

TABLE 4

| | Compound of Formula (I) | | Compound of Formula (II) | | Photographic Characteristic 1 | | Photographic Characteristic 2 | | Photographic Characteristic 3 | | |
|---|---|---|---|---|---|---|---|---|---|---|---|
| No. | Type | Amount (mol/mol Ag) | Type | Amount (mol/mol Ag) | Sensitivity | γ | Sensitivity | γ | Sensitivity | γ | Remarks |
| 22 | I-12 | $1.8 \times 10^{-4}$ | | — | 100 | 14.0 | 91 | 12.5 | 75 | 80 | |
| 23 | " | $2.7 \times 10^{-4}$ | | — | 110 | 16.5 | 103 | 14.8 | 89 | 10.5 | |
| 24 | — | — | II-5 | $2 \times 10^{-3}$ | 100 | 16.0 | 75 | 8.5 | 91 | 14.0 | |
| 25 | — | — | " | $4 \times 10^{-3}$ | 108 | 17.0 | 90 | 9.5 | 115 | 15.0 | |
| 26 | I-12 | $1.4 \times 10^{-4}$ | " | $4 \times 10^{-4}$ | 100 | 17.5 | 98 | 16.0 | 98 | 16.0 | Invention |
| 27 | " | " | " | $5 \times 10^{-4}$ | 106 | 18.0 | 100 | 16.5 | 101 | 16.5 | " |
| 28 | " | $1.8 \times 10^{-4}$ | " | $1 \times 10^{-4}$ | 110 | 19 | 103 | 16.0 | 108 | 17.0 | " |
| 29 | " | " | " | $2 \times 10^{-4}$ | 118 | 19.5 | 102 | 16.5 | 112 | 17.0 | " |
| 30 | I-19 | $4.5 \times 10^{-4}$ | " | $5 \times 10^{-4}$ | 104 | 17.5 | 97 | 16.0 | 102 | 17.0 | " |

Photographic Characteristic 1:

The results were obtained when the film which had been stored for 1 day after coating was processed at 38° C. for 30 seconds by the use of an automatic developing machine FG660F (manufactured by Fuji Photo Film Co., Ltd.). The relative sensitivity is a relative value of the reciprocal of an exposure amount to provide a density of 1.5 upon development at 38° C. for 30 seconds, with that of Sample 1 as 100.

Photographic Characteristic 2:

The results obtained when the processing was performed in the same manner as above, but using a developer which had been used in processing 200 sheets of Fuji GO-100 film (size: 50.8 cm×61.0 cm) which had been entirely exposed to light.

Photographic Characteristic 3:

The results were obtained when the film which had been stored for 3 days under the conditions of a temperature of 50° C. and a relative humidity of 75% was processed in the same manner as in the case of Photographic Characteristic 1.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having at least one light-sensitive silver halide emulsion layer on the support, wherein at least one of the emulsion layer and other constituent layers contains at least one compound represented by formula (I) and at least one compound represented by formula (II):

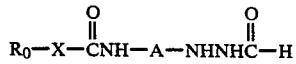

(I)

wherein $R_0$ is an organic group having 7 to 30 carbon atoms, A is a substituted or unsubstituted phenylene group, or a substituted or unsubstituted naphthylene group, and X is NH or 0,

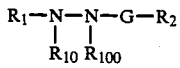

(II)

wherein $R_1$ is an aliphatic, aromatic or heterocyclic group; $R_2$ is a hydrogen atom, a substituted or unsubstituted alkyl group, a substituted or unsubstituted aralkyl group, a substituted or unsubstituted alkoxy group, a substituted or unsubstituted aryl group, a substituted or unsubstituted aryloxy group, or a substituted or unsubstituted amino group; G is a carbonyl group, a sulfoxy group, a phosphoryl group, or an N-substituted or unsubstituted iminomethylene group (NH=C<); $R_{10}$ and $R_{100}$ are both hydrogen, atoms, or one of $R_{10}$ and $R_{100}$ is a hydrogen atom and the other is a substituted or unsubstituted alkylsulfonyl group, a substituted or unsubstituted arylsulfonyl group, or an acyl group; and G, $R_2$, $R_{100}$ and the nitrogen atom to which G, $R_2$ and $R_{100}$ are linked may form a partial structure of hydrazone (—N=C<), provided that the compound represented by formula (II) is not the same with the compound represented by formula (I), and the total number of carbon atoms of $R_1$ and $R_2$ is 14 to 60 wherein said compound represented by formula (I) and said compound represented by formula (II) are present in an amount sufficient to increase contrast and to prevent decreased sensitivity and gradiation following storage, and reduction in sensitivity and gamma value resulting from processing in a low activity developer of said halide photographic material.

2. A silver halide photographic material as claimed in claim 1, wherein the compound represented by formula (II) is a compound represented by formula (III):

$$R_3\text{-}(L)_n\text{-}Y\text{-}NHNHC(=O)\text{-}R_4 \quad \text{(III)}$$

wherein Y is a substituted or unsubstituted phenylene group; L is —CONH—, —$SO_2$NH—, —O—, —S—, or $$-\overset{R_5}{\overset{|}{N}}CONH-$$

(wherein $R_5$ is hydrogen atom or a substituted or unsubstituted alkyl group); n is 0 or 1; $R_3$ is an organic group having 7 or more carbon atoms; and $R_4$ is a hydrogen atom, a substituted or unsubstituted alkyl group, a substituted or unsubstituted phenyl group, a substituted or unsubstituted aralkyl group, a substituted or unsubstituted alkoxy group, or a substituted or unsubstituted phenoxy group.

3. A silver halide photographic material as claimed in claim 1, wherein an amount of the compound represented by formula (I) is $1\times10^{-6}$ to $1\times10^{-2}$ mol per mol of silver of the silver halide photographic material, and an amount of the compound represented by formula (II) is $1\times10^{-5}$ to $1\times10^{-1}$ mol per mol of silver of the silver halide photographic material.

4. A silver halide photographic material as claimed in claim 2, wherein an amount of the compound represented by formula (III) is $1\times10^{-5}$ to $1\times10^{-1}$ mol per mol of silver of the silver halide photographic material.

5. A silver halide photographic material as claimed in claim 1, wherein a molar ratio of the compound represented by formula (I) to the compound represented by formula (II) is 1/20 to 10/1.

6. A silver halide photographic material as in claim 2, wherein when $R_5$ is a hydrogen atom, $R_4$ is not a hydrogen atom.

* * * * *